US010677271B2

(12) United States Patent
Birje

(10) Patent No.: US 10,677,271 B2
(45) Date of Patent: Jun. 9, 2020

(54) HYDRAULIC CYLINDER

(71) Applicant: EATON INTELLIGENT POWER LIMITED, Dublin (IE)

(72) Inventor: Sandeep Manohar Birje, Maharashtra (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 259 days.

(21) Appl. No.: 15/830,690

(22) Filed: Dec. 4, 2017

(65) Prior Publication Data

US 2018/0156248 A1 Jun. 7, 2018

(30) Foreign Application Priority Data

Dec. 5, 2016 (IN) ..... 201611041569

(51) Int. Cl.

| | |
|---|---|
| ***F15B 15/16*** | (2006.01) |
| ***F15B 15/14*** | (2006.01) |
| ***F15B 15/24*** | (2006.01) |
| *A61G 7/012* | (2006.01) |

(52) U.S. Cl.

CPC ..... *F15B 15/16* (2013.01); *F15B 15/24* (2013.01); *A61G 7/012* (2013.01); *F15B 15/1457* (2013.01)

(58) Field of Classification Search

CPC ..... F15B 7/001; F15B 7/005; F15B 11/0325; F15B 15/24; F15B 15/16

USPC ..... 92/52

See application file for complete search history.

(56) References Cited

U.S. PATENT DOCUMENTS 2,505,009 A * 4/1950 Schroeder ..... B66F 9/08 187/229
2,634,587 A * 4/1953 Ptak ..... B66F 9/22 92/52
2,649,842 A * 8/1953 Caldwell ..... F15B 15/22 92/52
2,806,449 A * 9/1957 Simmons ..... F01B 17/00 91/167 R
4,479,633 A * 10/1984 McCreery ..... B66B 9/04 254/93 R
4,539,893 A * 9/1985 Zingl ..... F01B 15/02 92/110
4,993,226 A * 2/1991 De Kok ..... F15B 11/0325 60/547.1

(Continued)

OTHER PUBLICATIONS

Atlas Automotive Equipment, "Chain-Over Roller (3 FT) Cylinder" and "Direct Drive Cylinder" Atlas Equipment Catalog, 2016, pp. 7 & 10.

*Primary Examiner* — Nathaniel E Wiehe
*Assistant Examiner* — Richard C Drake
(74) *Attorney, Agent, or Firm* — Merchant & Gould P.C.

(57) ABSTRACT

A hydraulic cylinder may include a cylindrical body, a first piston rod coupled with a first end of the body, and a second piston rod coupled with a second end of the body. The first piston rod may include a cavity with an inner diameter, and the second piston rod may have an outer diameter that is smaller than the inner diameter of the cavity. The hydraulic cylinder is adjustable from a closed position, in which a length of the first piston rod is housed inside the body and a length of the second piston rod is housed inside the cavity of the first piston rod, to an extended position, in which the first piston rod extends through the first end of the body and the second piston rod extends through the second end of the body.

15 Claims, 6 Drawing Sheets

(56) References Cited

U.S. PATENT DOCUMENTS

| | | | | | |
|---|---|---|---|---|---|
| 5,483,796 | A * | 1/1996 | Ando | ..... | B22D 17/26<br>60/560 |
| 6,325,601 | B2 * | 12/2001 | Wu | ..... | F04B 33/005<br>417/469 |
| 2013/0098240 | A1 * | 4/2013 | Wu | ..... | F15B 3/00<br>92/82 |

* cited by examiner

HYDRAULIC CYLINDER

This application claims benefit of Serial No. 201611041569, filed 5 Dec. 2016 in India and which application is incorporated herein by reference. To the extent appropriate, a claim of priority is made to the above disclosed application.

TECHNICAL FIELD

This application is generally directed to hydraulic cylinders, such as but not limited to cylinders used for raising and lowering beds.

BACKGROUND

A number of different types of beds, for example hospital beds, are designed to raise and lower. For example, hospital beds may be designed to raise and lower in a straight configuration and/or one or more parts of the bed may incline and decline. One particular example is the bed of an MRI (magnetic resonance imaging) machine. Such beds need to move in and out of the MRI circular magnet and also need to raise and lower. Typically, a hydraulic cylinder is incorporated into the MRI bed to allow for the raising and lowering. Although such cylinders work well, they can sometimes have size constraints, and they can also have structural weak points from side loads applied to the cylinders.

Therefore, it would be desirable to have an improved hydraulic cylinder for use in beds, such as MRI beds and other hospital beds. It would also be desirable if the improved hydraulic cylinders could be used or adapted or use with other devices and systems. At least some of these objectives will be addressed by the embodiments described in this application.

BRIEF SUMMARY

In one aspect of the present disclosure, a hydraulic cylinder may include a cylindrical body; a first piston rod coupled with a first end of the body, and a second piston rod coupled with a second end of the body. The first piston rod has a cavity with an inner diameter; and the second piston rod has an outer diameter that is smaller than the inner diameter of the cavity. The hydraulic cylinder is adjustable from a closed position, in which at least a majority of a length of the first piston rod is housed inside the body and at least a majority of a length of the second piston rod is housed inside the cavity of the first piston rod, to an extended position, in which the first piston rod extends through the first end of the body and the second piston rod extends through the second end of the body.

In some embodiments, the hydraulic cylinder may include a first head on the first end of the body and a second head on the second end of the body. Some embodiments may also include a first injection port on the first head, for injecting hydraulic fluid into the hydraulic cylinder, and a second injection port on the second head, for injecting hydraulic fluid into the hydraulic cylinder. In some embodiments, the body, the first head and the second head are three separate parts connected together. In alternative embodiments, the body, the first head and the second head are a one-piece, monolithic structure. In alternative embodiments, at least one injection port is located in the body for injecting hydraulic fluid and for allowing the hydraulic fluid to escape the cylinder.

In some embodiments, a first stop member may be coupled with one end of the first piston rod to prevent it from sliding out of the first end of the body in the extended position, and a second stop member may be coupled with one end of the second piston rod to prevent it from sliding out of the second end of the body in the extended position.

In another aspect of the disclosure, a method of manufacturing a hydraulic cylinder may involve attaching a first piston rod with a first end of a cylindrical body so that it is free to slide back and forth through the first end of the body and attaching a second piston rod with a second end of the body so that it is free to slide in and out of the second end of the body. Again, the first piston rod has a cavity with an inner diameter, the second piston rod has an outer diameter that is smaller than the inner diameter of the cavity, and the first and second piston rods translate in and out of the body of the cylinder between closed and extended positions. In the closed position, the second piston nests at least partially within the cavity of the first piston, and both pistons are located at least in part within the body of the cylinder.

In some embodiments, the method may further involve attaching a first head to the first end of the body and attaching a second head to the second end of the body. In some embodiments, the first head and the second head each include an injection port. The method may also include attaching a first stop member with one end of the first piston rod, where the first stop member is configured to abut the first head to prevent the first piston rod from sliding out of the first end of the body in the extended position, and attaching a second stop member with one end of the second piston rod, where the second stop member is configured to abut the second head to prevent the second piston from sliding out of the second end of the body in the extended position.

In yet another aspect of this disclosure, a hydraulic actuator may include: an elongate piston receiver having a first end, an opposite second end, and a longitudinal axis that extends between the first and second ends; a first piston moveable relative to the piston receiver along the longitudinal axis between an extended position, in which a majority of a length of the first piston extends outwardly beyond the first end of the piston receiver, and a retracted position, in which a majority of the length of the first piston element is positioned within the piston receiver; and a second piston moveable relative to the piston receiver along the longitudinal axis between an extended position, in which a majority of a length of the second piston element extends outwardly beyond the second end of the piston receiver, and a retracted position, in which a majority of the length of the second piston element is positioned within the piston receiver. The first piston fits inside the second piston when the first and second pistons are in the retracted positions.

In some embodiments, the piston receiver is a cylinder. In some embodiments, the first piston nests within the second piston when the first and second pistons are in the retracted positions. The hydraulic actuator may be a single acting actuator, according to some embodiments. In some embodiments, the piston receiver defines a port for allowing pressurized hydraulic fluid to be provided within the piston receiver for driving the first and second pistons from the retracted positions to the extended positions. In some embodiments, the first and second pistons concurrently move from the retracted positions to the extend positions.

Optionally, at least a majority of the lengths of the first and second pistons may overlap when the first and second pistons are in the retracted positions. In some embodiments, at least a majority of the length of the first piston is positioned within the second piston when the first and second pistons are in the retracted positons. In some embodiments, the first piston is a solid piston rod and the second piston is a hollow piston rod.

These and other aspects and embodiments of the present application are described in further detail below, in relation to the attached drawing figures.

DETAILED DESCRIPTION

The following description focuses on various embodiments of a hydraulic cylinder device, which may also be referred to as a "hydraulic cylinder," "hydraulic actuator" or any other similar term. The cylinder may be used, for example, in a bed, such as a hospital or MRI bed, for lowering and raising the bed. This is but one example of a use for the described hydraulic cylinder embodiments, however, and the description of this example should not be interpreted as limiting the scope of the invention. In various embodiments, the hydraulic cylinder described herein may be used for any suitable purpose and with any suitable device or system.

Figure 1A:
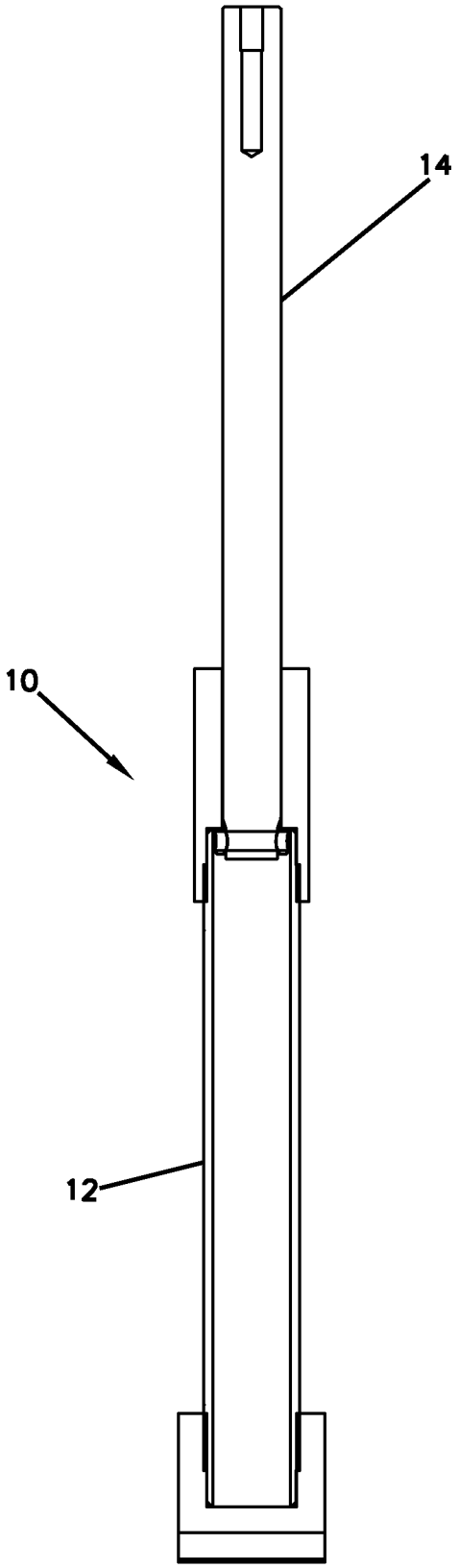
FIG. 1A (PRIOR ART)
FIGS. 1A and 1B are side, cross-sectional views of a prior art hydraulic cylinder device, illustrated in an extended configuration and a closed configuration, respectively.
Figure 1B:
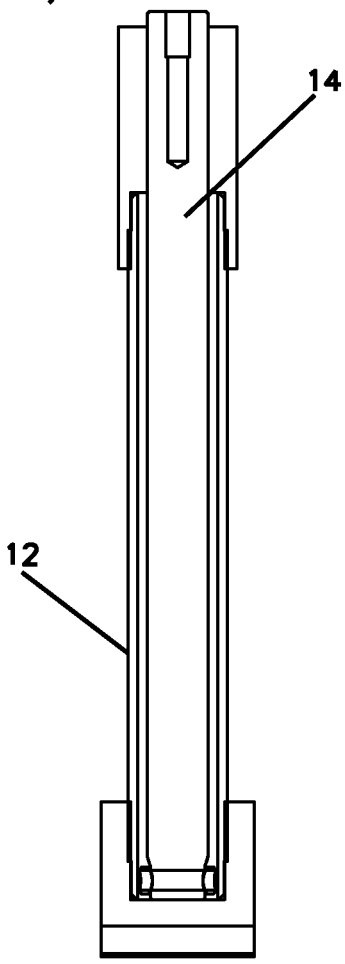
FIG. 1B (PRIOR ART)

Referring to FIGS. 1A and 1B, a prior art hydraulic cylinder 10, which may be used to lower and raise a hospital or MRI bed, typically includes a body 12 and a piston rod 14 (or simply a "piston"). Hydraulic fluid, such as oil, is injected into body 12, through an injection port, to cause piston rod 14 to extend through one end of body 12 to an extended position, as illustrated in FIG. 1A. To lower the bed, the hydraulic fluid is allowed to pass back out of the injection port via gravity, and piston rod 14 slides into body 12 so that it is mostly or entirely housed within body 12. This type of hydraulic cylinder 10 is sometimes referred to as a "single acting cylinder," because fluid is actively passed into cylinder 10 and then is allowed to passively move out of cylinder 10 (e.g., with gravity).

To improve the design of certain beds, such as an MRI bed, it may be desirable to have a hydraulic cylinder with a shorter length in the closed configuration (FIG. 1B) but having the same length in the extended configuration (FIG. 1A). For example, a shorter closed length may allow a bed to be lowered further, to accommodate shorter patients, while maintaining the same extending length will help accommodate for taller patients, thus providing a larger range of heights for the bed. Achieving a shorter closed length while retaining the same extended length may be difficult or even impossible using a single-piston design, such as the one shown in FIGS. 1A and 1B. One possible solution could be to attach two shorter, single-piston cylinders together, facing in opposite directions. However, this solution would require additional space for mounting the cylinders and may result in an unacceptable side load on the cylinders. Another solution might be a multi-level telescopic cylinder. However, a telescopic cylinder may be difficult and expensive to manufacture, and it may also be less reliable due to its larger number of parts, seals and concentric surfaces. Also, the diameter of the cylinder would have to increase to accommodate all the telescopic pieces.

Referring now to FIGS. 2A-2F, one embodiment of a two-piston hydraulic cylinder 20 is illustrated. This hydraulic cylinder 20 may provide a solution to the challenges discussed above, because it includes two, nesting pistons that allow for a shorter closed configuration length while still achieving a desired extended length. As most clearly viewed in FIG. 2B, cylinder 20 may include a body 22, a first head 24, a second head 26, a first piston rod 28 with an inner cavity 29, and a second piston rod 30 that fits at least partway into first piston rod 28. First piston rod 28 extends through first head 24 and a first end of body 22, and second piston rod 30 extends through second head 26 and a second end of body 22. In this embodiment, a first stop member 32 is attached to first piston rod 28 at or near one end, and a second stop member 34 is attached to second piston rod 30 at one end. First head 36 includes a first injection port 36, and second head 26 includes a second injection port 38.

Figure 2A:
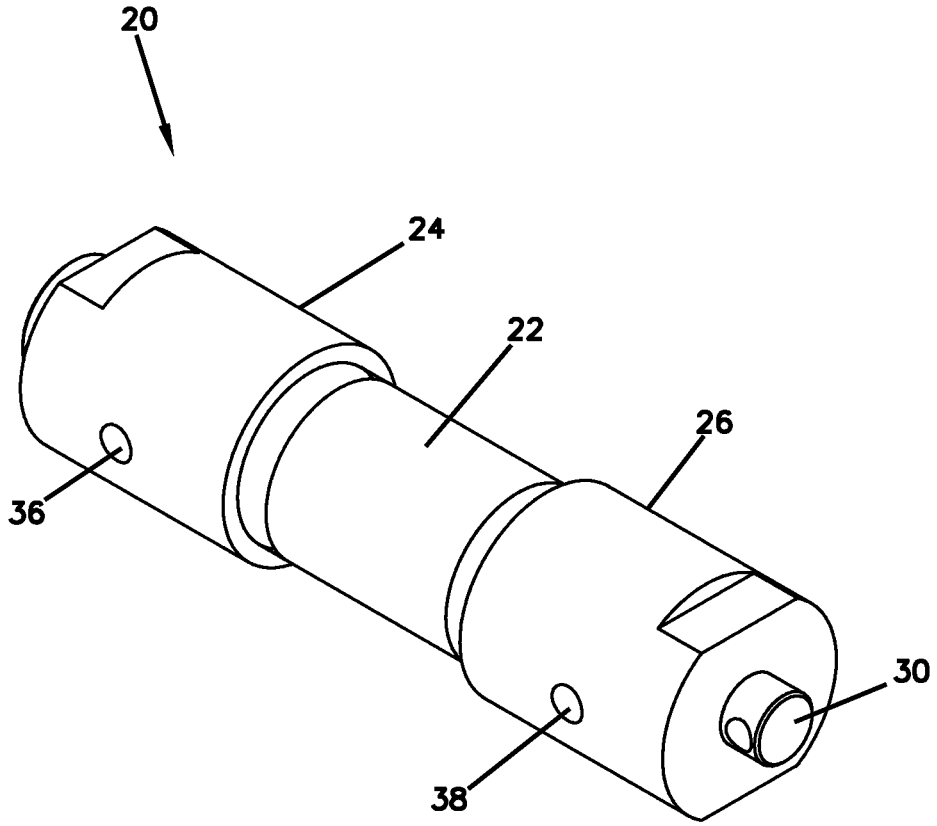
FIGS. 2A and 2B are perspective and exploded views, respectively, of a hydraulic cylinder device with nesting pistons, according to one embodiment.
Figure 2B:
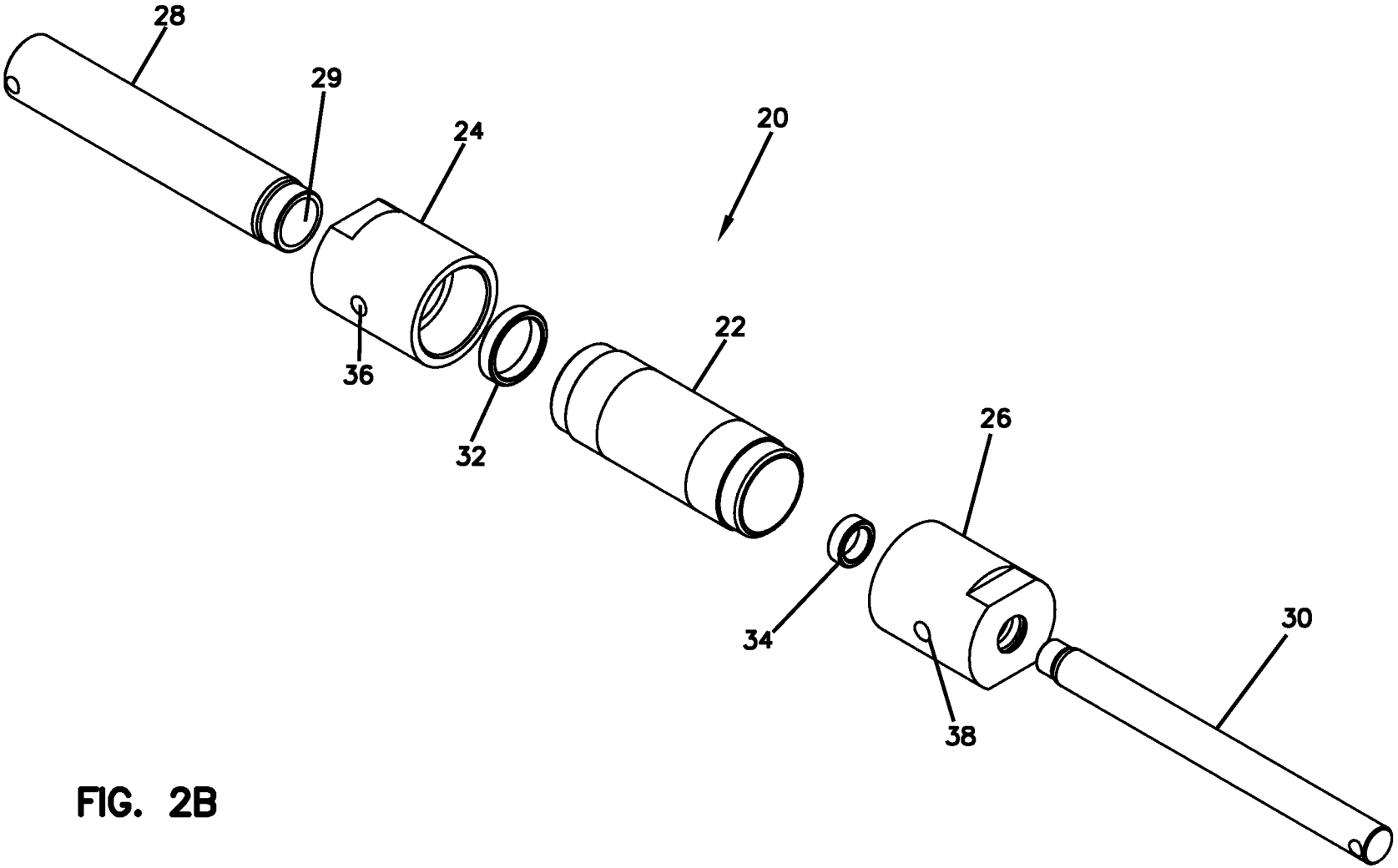
Figure 2D:
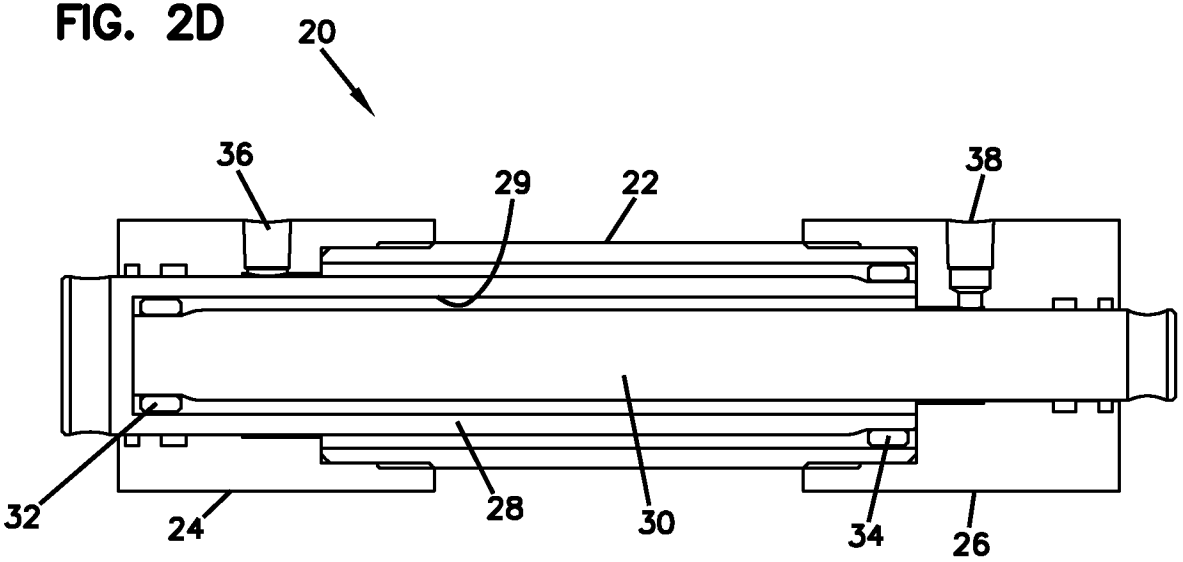
FIG. 2D is a side, cross-sectional view of the hydraulic cylinder device of FIGS. 2A and 2B, illustrated in a closed configuration, from the perspective of the line drawn through FIG. 2C.
Figure 2C:
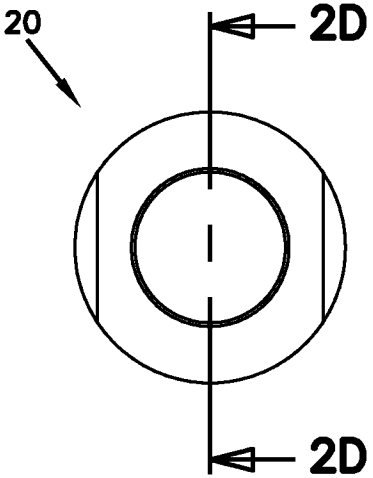
FIG. 2C is an end-on view of the hydraulic cylinder device of FIGS. 2A and 2B.
Figure 2E:
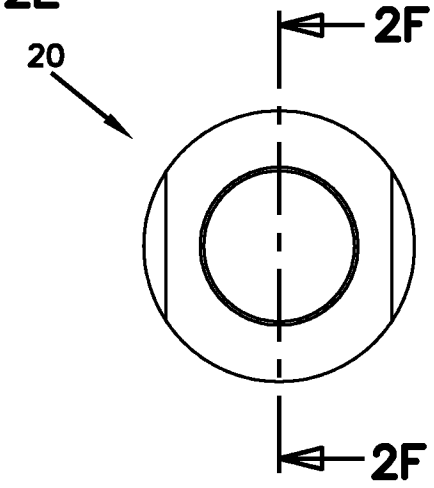
FIG. 2E is an end-on view of the hydraulic cylinder device of FIGS. 2A and 2B.

FIGS. 2A and 2D show cylinder 20 in a fully closed, collapsed or nested position. As evident from FIG. 2D, in the closed position, a majority of the length of second piston rod 30 nests within cavity 28 of first piston rod 28. A majority of the length of first piston rod 28 resides within body 22. Thus, both first piston rod 28 and second piston rod 30 reside mostly within body 22 in the closed configuration. The inner diameter of first piston rod 28 is sufficient to accommodate the outer diameter of second piston rod 30. Although body 22, first head 24 and second head 26 are shown as three separate pieces in FIG. 2B, in alternative embodiments these three features may actually be a one-piece, monolithic structure. In such instances, the entire structure may be referred to as the "body." Therefore, when this disclosure refers to a majority of a length of first piston rod 28 and/or second piston rod 30 residing within the "body" of cylinder 20, the term "body" may refer to a component like body 22 in some embodiments, and may refer to body 22 plus first head 24 and second head 26 in other embodiments.

Figure 2F:
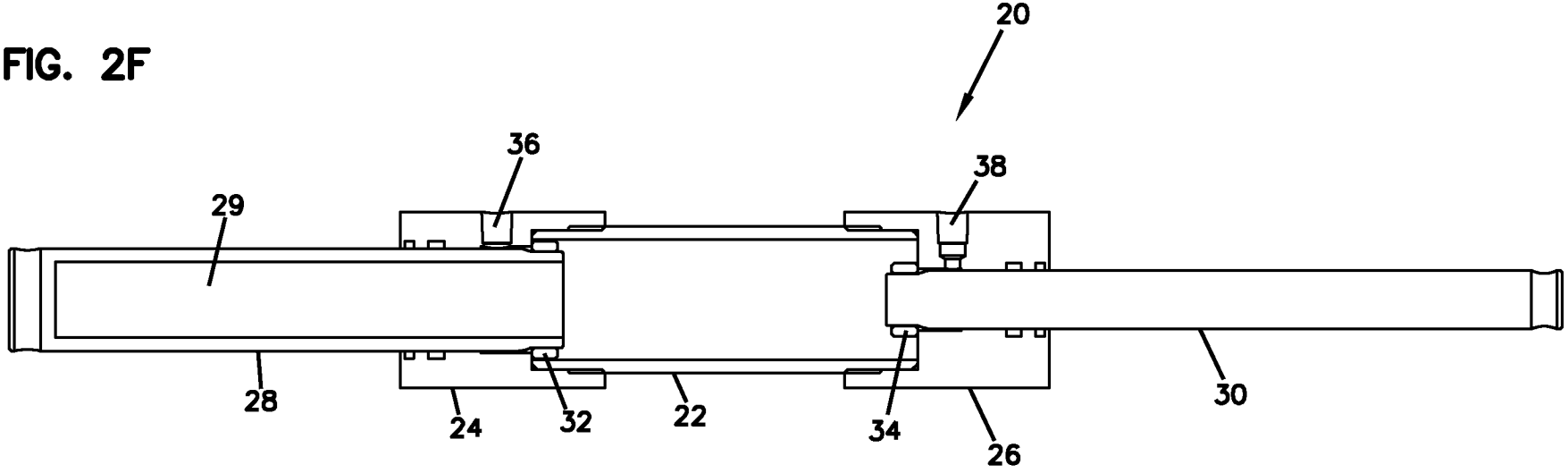
FIG. 2F is a side, cross-sectional view of the hydraulic cylinder device of FIGS. 2A and 2B, illustrated in a closed configuration, from the perspective of the line drawn through FIG. 2E.

To extend cylinder 20, injection fluid, such as oil, water or any other suitable injection medium, may be passed into body 22 via first injection port 36 and/or second injection port 38. As fluid is injected, first piston rod 28 extends through the first end of body 22 and first head 24, and second piston rod 30 extends through the second end of body 22 and second head 26. Eventually the fully extended position is reached, as illustrated in FIG. 2F. In the fully extended position, first stop 32 abuts first head 24 and thus prevents first piston rod 28 from passing out of the first end of body 22, and second stop 34 abuts second head 26 and thus prevents second piston rod 30 from passing out of the second end of body 22. To return to the closed configuration of FIG. 2D, fluid may be allowed to pass out of, cylinder 20, via one or both injection ports 36, 38. In some embodiments, the fluid may be allowed to pass out under the force of gravity. In alternative embodiments, the fluid may be actively evacuated out of cylinder 20.

Cylinder 20 may have virtually any combination of lengths and diameters, depending on the use of cylinder 20. For example, in embodiments for use in an MRI bed, cylinder 20 may have a total extended length of between about 20 cm and about 35 cm, and more ideally between about 25 cm and about 30 cm, and in one embodiment between about 26 cm and about 27 cm. The same cylinder 20 may have a closed/collapsed length of between about 7 cm and about 20 cm, and more ideally between about 10 cm and about 15 cm, and in one embodiment between about 12 cm and about 13 cm.

Figure 3A:
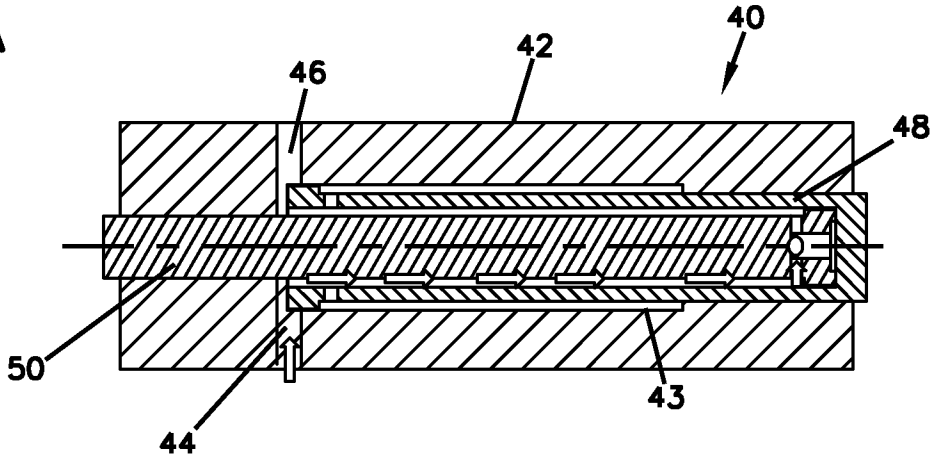
FIGS. 3A and 3B are side, cross-sectional views of a hydraulic cylinder device, illustrating the flow of hydraulic fluid into the device to extend the device from a closed configuration (FIG. 3A) to an extended configuration (FIG. 3B).
Figure 3B:
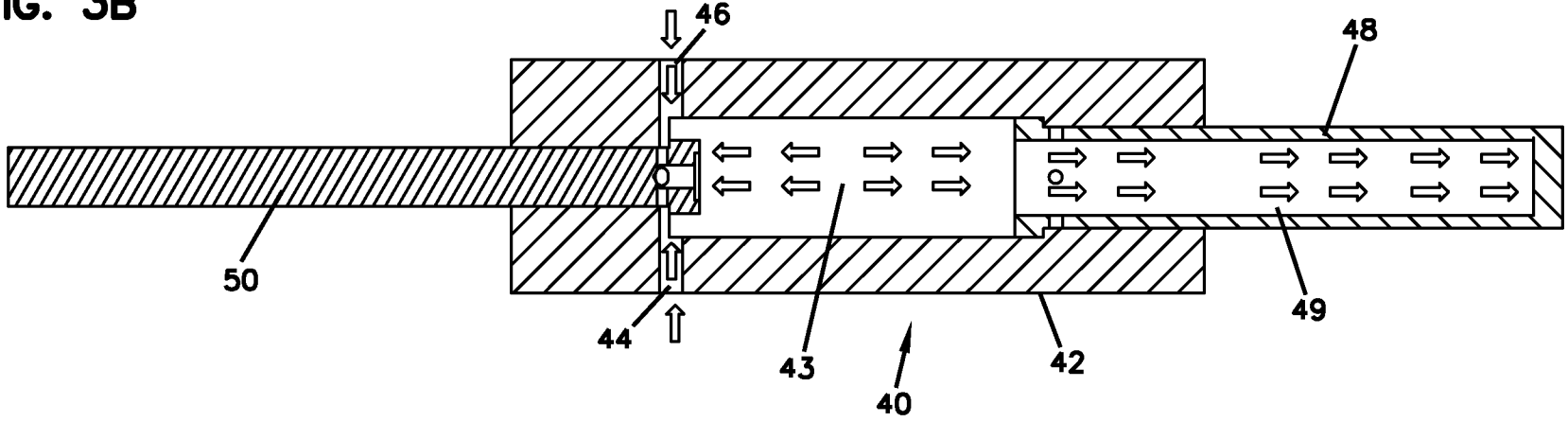

Referring now to FIGS. 3A and 3B, another embodiment of a hydraulic actuator 40 (or "hydraulic cylinder") is illustrated in a closed position (FIG. 3A) and an extended position (FIG. 3B). In both figures, solid-tipped arrows illustrate the flow of hydraulic fluid into hydraulic actuator 40 to change it from the closed position to the extended position. As shown in FIGS. 3A and 3B, hydraulic actuator 40 may include an elongate piston receiver 42 (or "body"), with a cavity 43, a first port 44 and a second port 46. Hydraulic actuator 40 also includes a first piston 48, which forms an inner cavity 49, and a second piston 50, which fits partially within cavity 49 in the closed configuration.

Hydraulic fluid may be introduced into hydraulic actuator 40 via first port 44, as illustrated in FIG. 3A. The fluid may first pass into inner cavity 49 of first piston 48. The fluid will exert pressure on a distal inner surface of inner cavity 49, thus causing first piston 48 to start moving out of a first end of piston receiver 42. As fluid continues to flow into piston receiver 42, as shown in FIG. 3B, the fluid fills cavity 43, and thus exerts force against a proximal end of second piston 50, thus driving second piston 50 out of a second end of piston receiver 42. In some embodiment, as illustrated, fluid may be advanced into hydraulic actuator 40 via two ports 44, 46, as in FIG. 3B. Alternatively, fluid may be advanced via only one port 44, as in FIG. 3A, or via more than two ports in other embodiments. Similarly, fluid may be allowed (or caused) to pass out of hydraulic actuator 40 via one port 44, 46 or multiple ports, according to various embodiments. In one embodiment, fluid is simply introduced through one port 44 or 46 and allowed to flow out via the same port 44 or 46.

Although the above description is believed to be complete and accurate, the description is directed toward various exemplary embodiments, and these examples should not be interpreted as limiting the scope of the invention as it is defined by the claims. For example, various alternative embodiments may include fewer components or a greater number of components than the embodiments described above. The methods described herein may also include fewer steps or a greater number of steps and/or the method steps may be performed in a different order. Therefore, the embodiments described herein should not be interpreted as limiting the scope of the invention.

I claim:

1. A hydraulic actuator, comprising:

an elongate piston receiver having a first end, an opposite second end, and a longitudinal axis that extends between the first and second ends;

a first piston consisting of a solid piston rod moveable relative to the piston receiver along the longitudinal axis between an extended position, in which a majority of a length of the first piston extends outwardly beyond the first end of the piston receiver, and a retracted position, in which a majority of the length of the first piston element is positioned within the piston receiver; and a second piston consisting of a hollow piston rod moveable relative to the piston receiver along the longitudinal axis between an extended position, in which a majority of a length of the second piston element extends outwardly beyond the second end of the piston receiver, and a retracted position, in which a majority of the length of the second piston element is positioned within the piston receiver, wherein the first piston fits inside the second piston when the first and second pistons are in the retracted positions.

2. The hydraulic actuator of claim 1, wherein the piston receiver is a cylinder.

3. The hydraulic actuator of claim 1, wherein the first piston nests within the second piston when the first and second pistons are in the retracted positions.

4. The hydraulic actuator of claim 1, wherein the hydraulic actuator is a single acting actuator.

5. The hydraulic actuator of claim 1, wherein the piston receiver defines a port for allowing pressurized hydraulic fluid to be provided within the piston receiver for driving the first and second pistons from the retracted positions to the extended positions.

6. The hydraulic actuator of claim 5, wherein the first and second pistons concurrently move from the retracted positions to the extended positions.

7. The hydraulic actuator of claim 1, wherein at least a majority of the lengths of the first and second pistons overlap when the first and second pistons are in the retracted positions.

8. The hydraulic actuator of claim 1, wherein at least a majority of the length of the first piston is positioned within the second piston when the first and second pistons are in the retracted positions.

9. A hydraulic actuator, comprising:

an elongate piston receiver having a first end, an opposite second end, and a longitudinal axis that extends between the first and second ends;

a first piston moveable relative to the piston receiver along the longitudinal axis between an extended position, in which a majority of a length of the first piston extends outwardly beyond the first end of the piston receiver, and a retracted position, in which a majority of the length of the first piston element is positioned within the piston receiver; and a second piston moveable relative to the piston receiver along the longitudinal axis between an extended position, in which a majority of a length of the second piston element extends outwardly beyond the second end of the piston receiver, and a retracted position, in which a majority of the length of the second piston element is positioned within the piston receiver, wherein the first piston fits inside the second piston when the first and second pistons are in the retracted positions, wherein the piston receiver defines a port for allowing pressurized hydraulic fluid to be provided within the piston receiver for driving the first and second pistons from the retracted positions to the extended positions, and wherein the first and second pistons concurrently move from the retracted positions to the extended positions.

10. The hydraulic actuator of claim 9, wherein the piston receiver is a cylinder.

11. The hydraulic actuator of claim 9, wherein the first piston nests within the second piston when the first and second pistons are in the retracted positions.

12. The hydraulic actuator of claim 9, wherein the hydraulic actuator is a single acting actuator.

13. The hydraulic actuator of claim 9, wherein at least a majority of the lengths of the first and second pistons overlap when the first and second pistons are in the retracted positions.

14. The hydraulic actuator of claim 9, wherein at least a majority of the length of the first piston is positioned within the second piston when the first and second pistons are in the retracted positions.

15. The hydraulic actuator of claim 9, wherein the first piston is a solid piston rod and the second piston is a hollow piston rod.

* * * * *